US005400067A

United States Patent [19]

Day

[11] Patent Number: 5,400,067

[45] Date of Patent: Mar. 21, 1995

[54] FOAM INSERTION FOR AN INK JET PRINT HEAD CARTRIDGE

[75] Inventor: Gayle C. Day, Lexington, Ky.

[73] Assignee: Lexmark International, Inc., Greenwich, Conn.

[21] Appl. No.: 165,763

[22] Filed: Dec. 10, 1993

[51] Int. Cl.[6] ..... B41J 2/175

[52] U.S. Cl. ..... 347/87; 29/451

[58] Field of Search ..... 347/86, 87; 29/451, 29/439, 235

[56] References Cited

U.S. PATENT DOCUMENTS

| | | | |
|---|---|---|---|
| 5,025,271 | 6/1991 | Baker et al. | 347/87 |
| 5,182,579 | 1/1993 | Haruta et al. | 347/87 |
| 5,319,841 | 6/1994 | Yata et al. | 29/451 |

OTHER PUBLICATIONS

Hewlett-Packard Journal, Aug. 1988, article entitled "Ink Retention in a Color Thermal Inkjet Pen" by E. Erturk, B. D. Gragg, M. E. Haviland, W. W. Rhods, J. L. Ruder, and J. E. Scheffelin, pp. 41–43.

*Primary Examiner*—Benjamin R. Fuller
*Assistant Examiner*—N. Le
*Attorney, Agent, or Firm*—John J. McArdle, Jr.

[57] ABSTRACT

A method and apparatus for inserting a compressed foam block into a generally rectangular ink jet print head ink chamber. The foam is compressed in an insertion tool which includes a compression area and compression fingers extending therefrom. A block of foam is placed in the principal area of the insertion tool and compressed in two dimensions, following which the ink jet print head is positioned around the compression fingers. The foam is pushed from the principal part of the insertion tool into the area surrounded by the compression fingers inside the print head ink chamber, and the force applied to the foam is continued. At a certain force level, the cartridge is allowed to move, under the force applied to the foam, off of the insertion fingers, leaving the foam inside the cartridge.

5 Claims, 2 Drawing Sheets

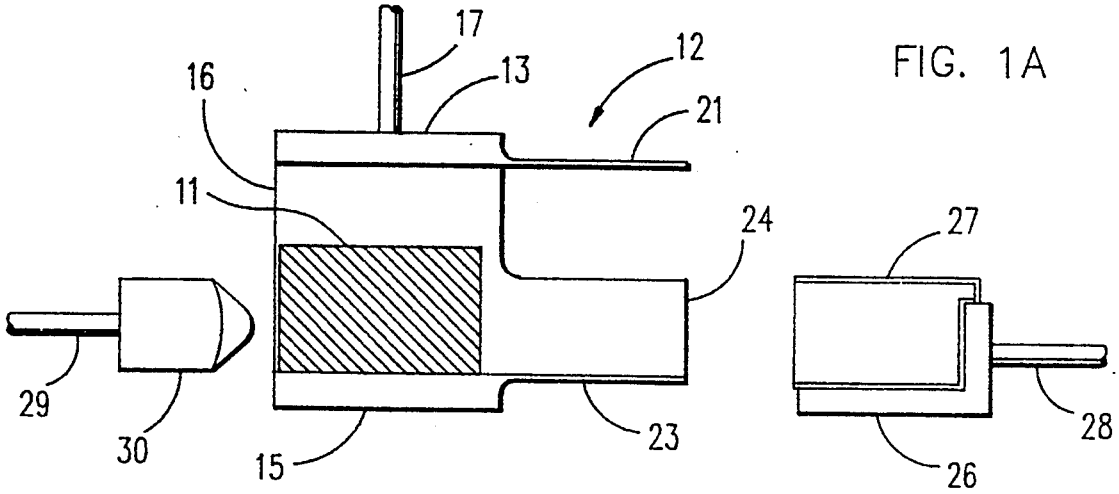
FIG. 1A
FIG. 1B
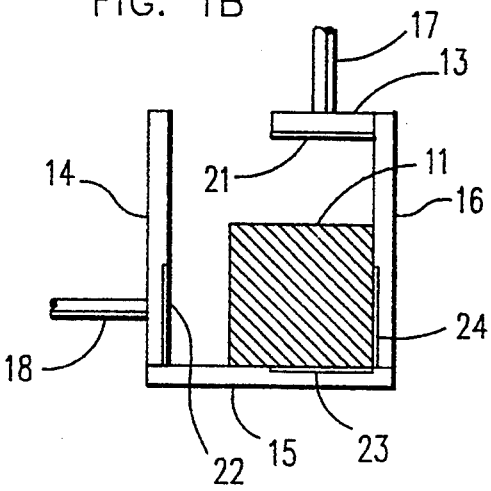
FIG. 2
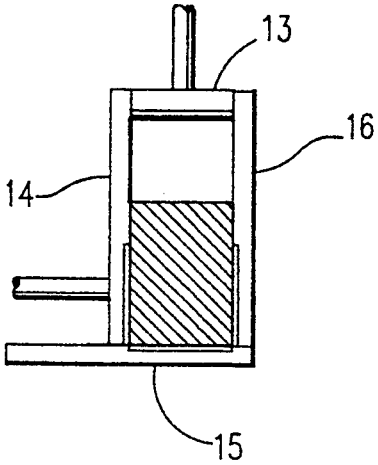
FIG. 3A
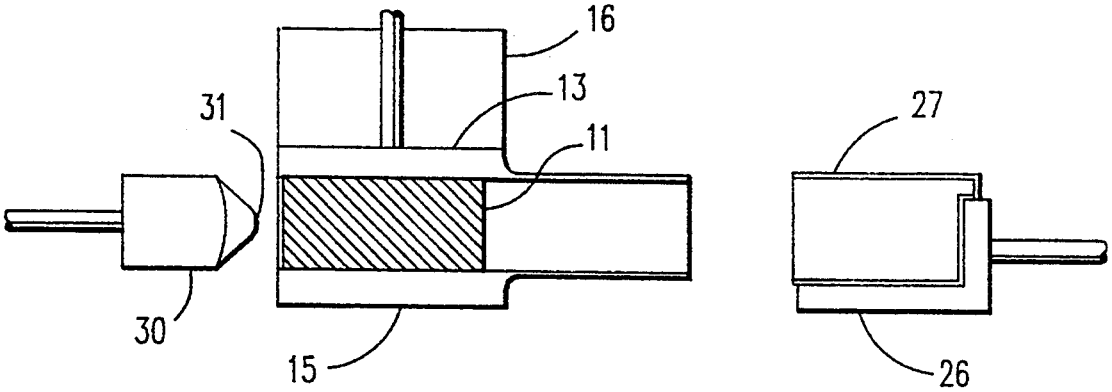

FOAM INSERTION FOR AN INK JET PRINT HEAD CARTRIDGE

BACKGROUND OF THE INVENTION

One technique for retaining ink in an ink chamber in an ink jet print head is to insert a compressed foam element into the ink chamber prior to filling the chamber with ink. The foam must be inserted into the chamber to a proper depth, generally to intimately contact a filter through which ink flows to reach the print head nozzles. The foam should be compressed against the internal walls of the ink chamber and, to the greatest extent possible, the corners of the chamber.

Therefore, the inserted foam should be wrinkle-free, without leaving corner voids, and inserted to the desired depth within the ink chamber.

One known way of inserting compressed foam into an ink chamber of an ink jet print head is to compress the foam within a compression device from which the foam is pushed into a thin walled tube. In a subsequent operation, the tube is inserted into the ink chamber and the foam extruded into the chamber by pushing the foam from behind as the tube is withdrawn.

It is an objective of the present invention to provide an improved method and apparatus for the insertion of compressed foam into an ink chamber of an ink jet print head.

This objective is met in accordance with one aspect of the present invention by the provision of a foam insertion tool which includes compression fingers. A foam element to be inserted into an ink chamber is compressed and pushed into an area within the compression fingers, which in turn are positioned within the ink chamber. A force applied to the foam first pushes the foam into the ink chamber and then the print head off of the compression fingers, with the foam being retained in the ink chamber.

BRIEF DESCRIPTION OF THE DRAWINGS

FIG. 1A is a diagrammatic side view of a foam insertion apparatus, with one compression plate removed, in accordance with the present invention; and FIG. 1B is a diagrammatic end view of the insertion tool and foam of FIG. 1A.

FIG. 2 is a view similar to that of FIG. 1B with the foam compressed in one dimension.

FIG. 3A is a view similar to that of FIG. 1A with the foam compressed in the insertion tool.

Figure 3B:
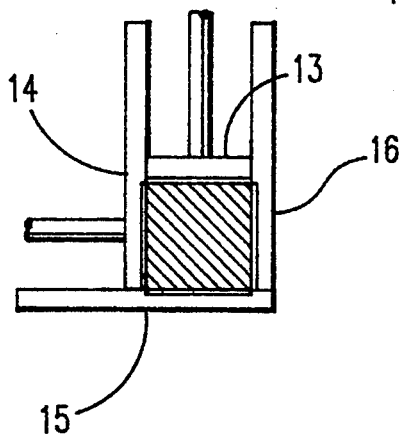
FIG. 3B is a view similar to that of FIG. 2 with the foam compressed in two dimensions.

With reference to the figures, an exemplary foam insertion process begins with a block of foam 11 positioned in an insertion tool indicated generally as 12. The insertion tool 12 includes movable plates 13 and 14 which are movable perpendicularly to one another to compress the foam 11 against fixed plates 15 and 16, respectively.

The plate 13 is driven by a rod 17 affixed thereto, and the plate 14 is driven by a rod 18 affixed thereto, each being driven by suitable force-applying means (not shown). Each plate 13–16 has an associated compression finger 21, 22, 23 or 24, respectively, associated therewith. The compression fingers 21–24 extend generally in the direction of a fixture 26 for holding an ink jet print head body 27 into which the foam 11 is to be inserted. The fixture 26 is driven by a rod 28 affixed thereto, with suitable motive force (not shown) being applied to the rod 28. Another force is provided (by means not shown) to a rod 29 to drive a RAM 30 to push the foam 11 into the area bounded by the compression fingers 21–24 after the foam is compressed.

In order to compress the foam 11, the plate 14 is moved to the right (as shown in FIG. 2), compressing the foam between the plates 14 and 16. The plate 13 is then driven toward the plate 15 (FIG. 3B) to compress the foam in the orthogonal direction.

In the illustrated form of the invention, the foam element 11 is a rectangular block of polyether-polyurethane foam, as supplied by Foamex Corporation as SIF FELT 03Z70A1598. The foam is supplied in sheets, and during the manufacturing process the foam sheet is "felted" to the desired thickness. This process forms a "skin" surface on the top and bottom of the sheet, which is distinguishable from the other surfaces after the sheets are cut to form the rectangular blocks of foam 11. The foam should be compressed in such a manner that the "felted" surfaces are compressed first, with compression of other surfaces second. Compression of the non-felted surfaces first will result in a crease or wrinkle forming on opposed felted surfaces. In FIGS. 2 and 3B, the felted surfaces of the foam 11 are those contacted by the plates 14 and 16 for the initial compression shown in FIG. 2.

Figure 4:
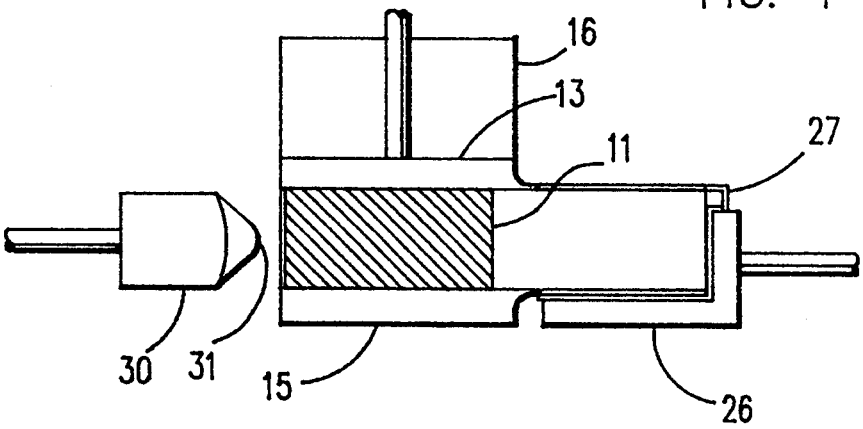
FIG. 4 is a view similar to that of FIGS. 1A and 3A with the print head body positioned on the compression fingers of the insertion tool.

With the foam element 11 compressed as shown in FIGS. 3A and 3B, the fixture 26 and print head body 27 are moved to the left (as shown in FIG. 4) so that the compression fingers 21–24 are received within the ink chamber of the print head body 27. The fingers 21–24 are 1.5 millimeters thick and are located, when the foam is fully compressed by the plates 13–16, to fit inside the print head body 27. The fingers 21–24 and plates 13–16 include Teflon (trademark) resin inner surfaces (those surfaces which contact the foam 11) preferably provided by adhering Teflon resin sheets to these surfaces to provide low friction with respect to the foam element 11. The compression fingers 21–24 are preferably integrally formed with the plates 13–16 and are Vega (trademark) air hardened, cold drawn, tool steel (AISI A6, ASTM A681).

Figure 5:
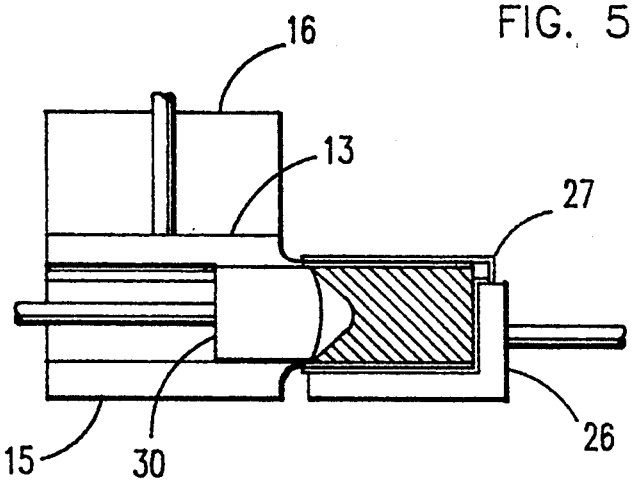
FIG. 5 is a view similar to that of FIG. 4 with the foam and print head body about to be pushed off of the compression fingers.

After the compression fingers 21–24 are positioned within the print head body 27, the RAM 30 is advanced (FIG. 5) pushing the foam 11 into the interior of the compression fingers and inside the cartridge body. The RAM 30 is advanced at a selected speed, contacting the foam and pushing it into the interior of the compression fingers, encountering the counter force of the fixture 26 holding the print head body 27 in place, until the counter force is overcome. After that, the RAM 30 pushes the foam and the print head body off of the compression fingers, completing the foam insertion process.

In the illustrated form, the print head body 27 is formed from a plastic material, Noryl (trademark) SE1-701 of General Electric Plastics. The interior of the print head body 27 is generally rectangular with dimensions of about 32 millimeters by about 39 millimeters. The RAM 30 is a rigid plastic material, the main body portion of which is about 28.8 millimeters by about 35.6 millimeters. The forward end of the RAM 30 is generally conical with a taper of about 45° truncated at a forward surface 31. The surface 31 is a flat circular surface having a diameter of about 15.9 millimeters.

As the foam 11 is inserted within the area bounded by the compression fingers 21–24, the fingers are spread slightly outwardly to contact the inner walls of the print head body 27. This permits the compression finger thickness to establish the spacing of the foam element 11 from the inner walls of the print head body 27 as the foam and the print head body move off of the fingers. The foregoing selection of the finger thickness for the materials and the insertion speed involved permits placement of the foam within the print head body without leaving voids.

In the present embodiment, the force applied to the RAM 30 is nominally about 50 pounds per square inch and the counter force applied to the fixture 26 is about 30 pounds per square inch. Adjustments are made to these values to obtain a smooth transition from the movement of the foam into the compression fingers to the movement of the foam and the print head body off of the compression fingers. In the present instance the speed of the RAM 30 is about 63.5 millimeters per second.

If there are interior features of the print head body 27, such as the earlier-mentioned filter structure at the bottom (upper right-most portion as viewed in the Figures), it is preferable that such features be spaced from the inside walls of the ink chamber to permit the compression fingers to extend fully to the bottom of the main area of the ink chamber so that the foam fully surrounds such internal features of the ink chamber.

I claim:

1. A method for inserting a foam element into an ink chamber of an ink jet print head comprising the steps of:

placing the foam element in an insertion tool which includes compression fingers;

compressing the foam element in two dimensions in the insertion tool to a size that will permit insertion of the compression fingers and the foam element into the ink chamber;

inserting the compression fingers into the ink chamber to a desired depth;

advancing the foam element within the insertion tool to a position within the compression fingers; and further advancing the foam element relative to the compression fingers by an application of force through the foam element to the ink jet print head to move the ink jet print head relative to the compression fingers, so that the compression fingers are withdrawn from the ink chamber leaving the foam in the ink chamber.

2. The method of claim 1 in which the step of further advancing the foam element relative to the compression fingers comprises applying a force to only the foam element to push the foam element and the ink jet print head off of the compression fingers.

3. The method of claim 1 in which the step of inserting the compression fingers into the ink chamber comprises moving the ink jet print head to a position over the compression fingers by an application of a first force to the ink jet print head, and in which the step of advancing the foam element within the insertion tool comprises moving the foam element by an application of a second force.

4. The method of claim 3 in which the second force exceeds the first force and the step of further advancing the foam relative to the compression fingers comprises further moving the foam under influence of the second force so that the foam exerts the second force on the ink jet print head, overcoming the first force and moving the ink jet print head and the foam off of the compression fingers.

5. Apparatus for inserting a foam element into an ink chamber of an ink jet print head comprising:

an insertion tool having compression plates and associated compression fingers extending from the compression plates;

means for moving the compression plates toward one another so that a foam element placed therebetween is compressed;

a fixture for holding an ink jet print head which includes an ink chamber, the ink chamber being sized to receive the compression fingers when the compression plates of the insertion tool are compressing a foam element;

means for positioning the fixture and the ink jet print head so that the ink jet print head is surrounding the compression fingers; and means for forcing the foam into an interior of the compression fingers and of the ink jet print head and for further forcing the foam and the ink jet print head off of the compression fingers.

* * * * *